US006702112B1

(12) United States Patent
Henderson

(10) Patent No.: US 6,702,112 B1
(45) Date of Patent: Mar. 9, 2004

(54) SOCKET HOLDING DEVICE

(76) Inventor: John Andrew Henderson, P.O. 271, C.R., 2356, Hardin, TX (US) 77561

( * ) Notice: Subject to any disclaimer, the term of this patent is extended or adjusted under 35 U.S.C. 154(b) by 0 days.

(21) Appl. No.: 10/101,575

(22) Filed: Mar. 21, 2002

(51) Int. Cl.[7] ..... B65D 85/02; B65D 85/20

(52) U.S. Cl. ..... 206/350; 206/378; 206/818; 224/904

(58) Field of Search ..... 206/3, 443, 377, 206/378, 379, 350, 818; 211/69, 70.6; 224/239, 240, 679, 681, 682, 684, 904, 918, 919, 931

(56) References Cited

U.S. PATENT DOCUMENTS 299,736 A * 6/1884 Carlin ..... 224/678
549,710 A * 11/1895 Evans ..... 224/678
3,578,152 A * 5/1971 Hartley ..... 206/3
4,415,092 A * 11/1983 Boyer ..... 211/69.1
D342,155 S * 12/1993 Borawski ..... D3/260
5,343,181 A * 8/1994 Negus ..... 335/285
6,053,316 A * 4/2000 Lo ..... 206/379
6,079,559 A * 6/2000 Lee ..... 206/378

* cited by examiner

*Primary Examiner*—David T. Fidei
(74) *Attorney, Agent, or Firm*—Harrison & Egbert

(57) ABSTRACT

A socket holding device having a body with a plurality of socket-receiving members affixed thereto. Each of the socket-receiving members has a generally tubular configuration with an open top and a closed bottom. A slot extends from the open top toward the closed bottom along each of the plurality of socket-receiving members. A magnet is positioned in the closed bottom of each of the socket-receiving members. A plurality of sockets of different sizes are respectively removably received in the plurality of socket-receiving members so as to be physically accessible from outside of the socket-receiving member through the slot. The socket is magnetically releasably retained by the magnet.

15 Claims, 3 Drawing Sheets

SOCKET HOLDING DEVICE

FIELD OF THE INVENTION

The present invention relates to sockets that are used in association with socket wrenches. More particularly, the present invention relates to devices for storing and holding such sockets during actual use. More particularly, the present invention relates to belt-mounted holding devices for sockets and other tools.

BACKGROUND OF THE INVENTION

Socket wrenches and drive sockets usable therewith are commonly stored and transported within tool boxes, along with an assortment of other hand tools. Finding the desired drive socket can incur a certain amount of inconvenience since the drive sockets are frequently mixed with one another and other small hand tools in a toolbox. Further, the desired drive socket must be removed from the tool box and examined to ensure it is the desired socket for the task at hand. A socket wrench, a collection of drive sockets, and one or more wrench extensions can constitute a sizable quantity of tools so as to take up considerable space in a tool box. As the tools within a tool box are not in clear view to the user, but rather must be removed from the tool box and inspected to determine size and length of the drive socket, all contribute toward the time required for accomplishing a certain task.

This is particularly a problem associated with garage door repair. Often, the tool belt utilized by the garage door repair man will have a pair or more of large pouches which can contain various tools and drive sockets. Typically, the repairman must reach randomly into one of his or her pockets so as to grasp a number of separate drive sockets. Each of the drive sockets is then physically inspected so as to locate the desired size of the drive socket.

Usually, during the repair of garage doors and associated mechanisms, a total of seven or less drive sockets are utilized in association with a socket wrench. However, there are a relatively large number of bolts upon which the various sizes of drive sockets must be applied. During a normal repair operation, the garage door repairman is constantly going back and forth between the various sizes of sockets. The amount of time spent identifying the proper size of socket and location of such a socket can contribute greatly to the inefficiency of the repair of the garage door and its associated mechanisms. As such, a need has developed so as to make the drive sockets available in a quick and convenient manner for access by the particular repairman.

It is an object of the present invention to provide a socket holding device which makes drive sockets easily available for access and use.

It is another object of the present invention to provide a socket holding device in which the sockets can be easily stowed during periods of non-use.

It is another object of the present invention to provide a socket holding device in which the various sizes of sockets can be stowed within a single storage device.

It is a further object of the present invention to provide a socket holding device that can be simply attached to the tool belt of a repairman.

It is a further object of the present invention to provide a socket holding device which greatly improves the efficiency of the repair activities of garage door repairmen.

It is still another object of the present invention to provide a socket holding device which avoids the accidental release of sockets from their desired location.

It is still a further object of the present invention to provide a socket holding device which is easy to use, relatively inexpensive and easy to manufacture.

These and other objects and advantages of the present invention will become apparent from a reading of the attached specification and appended claims.

BRIEF SUMMARY OF THE INVENTION

The present invention is a socket holding device comprising a body having a curved surface and a plurality of socket-receiving members formed on this curved surface. Each of the socket-receiving members has a generally tubular configuration with an open top and a closed bottom. Each of the socket-receiving members has a longitudinal axis which is generally transverse to the longitudinal axis of the body.

The body has a curved surface with a front face and a back face. The socket-receiving members are affixed to the front face. In particular, the socket-receiving members are integrally formed with the body on the front face of the body. The back face has a curvature suitable for residing around a portion of a human waist or on the surface of a tool belt.

Each of the plurality of socket-receiving members has a slot extending transverse to the longitudinal axis of the body. The slot extends across the surface of the tubular configuration opposite to the curved surface of the body.

Each of the plurality of socket-receiving members has a base positioned at the bottom thereof. This base has a magnet positioned therein. The base has a tubular configuration with an interior passageway generally coaxial with the generally tubular configuration of the socket-receiving member. The magnet is positioned in this interior passageway of the base. The base has a top edge. The magnet is positioned so as to have a top surface slightly below the top edge of the base.

The body has a first wing member extending outwardly from one side of the plurality of socket-receiving members. The body also has a second wing member extending outwardly from an opposite side of the plurality of socket-receiving members. An attaching means is formed on each of the first and second wing members for attaching the body to a tool belt. In particular, the attaching means can be a pair of holes formed on the first wing member and a pair of holes formed on the second wing member.

In the present invention, a plurality of sockets are respectively received in the plurality of socket-receiving members. These plurality of sockets have different sizes.

Each of the plurality of socket-receiving members has a chamfered surface at the open top. This chamfered surface narrows toward an interior passageway of the generally tubular configuration of each of the socket-receiving members. Access to the sockets can be obtained through the slot to the exterior surface of the sockets so as to allow each of the sockets to be pushed upwardly through the tubular configuration of the socket-receiving member so that the socket can be dispensed outwardly of the open top. After use, this particular size of socket can be returned to its original position within the socket-receiving member.

DETAILED DESCRIPTION OF THE INVENTION

Figure 1:
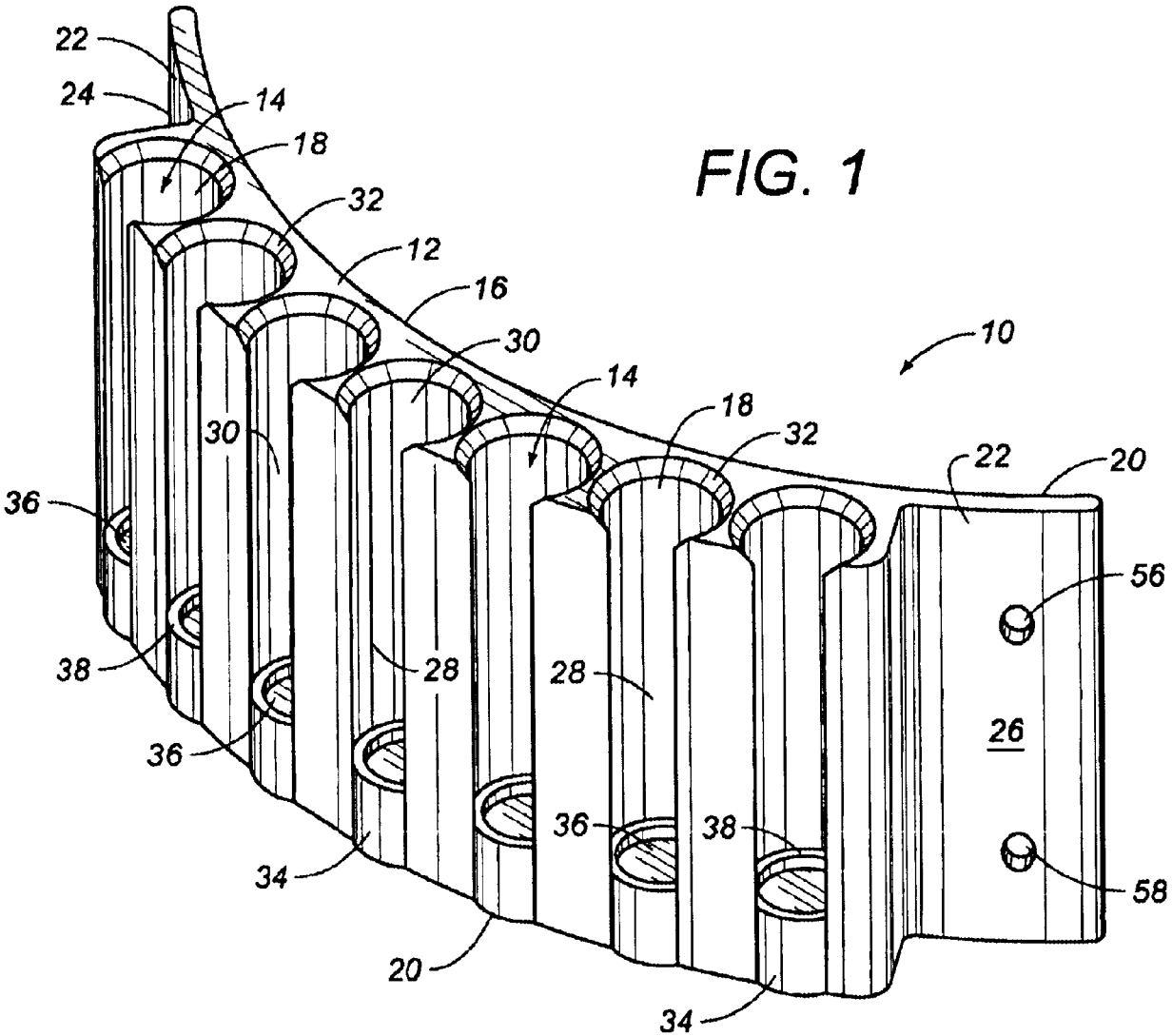
FIG. 1 is a perspective view of the socket holding device in accordance with the teachings of the present invention.

Referring to FIG. 1, there is shown the socket holding device 10 in accordance with the teachings of the preferred embodiment of the present invention. The socket holding device 10 includes a body 12 and a plurality of socket-receiving members 14 affixed to the body 12. The body 12 has a curved surface 16. Each of the socket-receiving members 14 has a generally tubular configuration with an open top 18 and a closed bottom 20.

The body 12 has curved surface 16 on a back face 20 of body 12. The curved surface 16 is suitably curved so as to generally conform to a portion of a human waist. The curved surface 16 is also suitably curved so as to be affixed to a tool belt which would extend around such human waist. The body 12 also has a front surface 22. The plurality of socket-receiving members 14 are affixed to the front surface 22 of the body 12. In particular, the plurality of socket-receiving members 14 are integrally formed with the body 12 of a polymeric material. For example, the socket holding device 10 of the present invention can be easily manufactured through an injection molding process. The body 12 also includes a first wing member 24 and a second wing member 26. The first wing member 24 extends outwardly from one side of the plurality of socket-receiving members 14. Similarly, the second wing member 26 extends outwardly from the opposite side of the plurality of socket-receiving members 14. The wing members 24 and 26 have a structure suitable for the placement of an attaching means thereon so as to facilitate the attachment of the socket holding device 10 to a tool belt or other appliance. For example, various types of fasteners can be attached to the wing members 24 and 26 so as to facilitate the proper attachment. Alternatively, as will be described hereinafter, a pair of holes can be formed on each of the wing members 24 and 26 so that the socket holding device 10 can be affixed by screws or bolts to the tool belt. The socket holding device can be placed in a convenient location relative to the various pouches that are used for the storage of drive sockets therein.

As can be seen in FIG. 1, each of the plurality of socket-receiving members 14 has a tubular configuration which extends transverse to the longitudinal axis of the body 12. Similarly, a slot 28 is formed on the forward surface of each of the socket-receiving members 14 so as to extend generally transverse to the longitudinal axis of the body 12. The slots 28 are formed on the surface of the tubular configuration of each of the socket-receiving members 14 opposite to the body 12.

Each of the socket-receiving members 14 has open top 18 facilitating the ability to remove sockets from the interior passageway 30 of each of the socket-receiving members 14. So as to further facilitate the ability to install each of the drive sockets into the interior passageway 30 of the respective socket-receiving members 14, a chamfered surface 32 is formed at the open top 18 of each of the socket-receiving members 14. The chamfered surface 32 acts as a funnel toward the interior passageway 30 of the respective socket-receiving members 14. In particular, the chamfered surface 32 narrows toward the interior passageway 30.

Each of the socket-receiving members 14 has a base 34 positioned at the bottom 20 thereof. Base 34 has a magnet 36 positioned therein. The base 34 is of a generally tubular configuration with an interior passageway generally coaxial with the interior passageway 30 of each of the socket-receiving members 14. The magnet 36 is positioned in the interior passageway of the base 34. The base 34 has a top edge 38. Each of the magnets 36 is positioned so as to have a top surface slightly below the top edge 38 of the base 34. As a result of this configuration, the base 34 will have a slight ledge at this top edge 38 so as to prevent any very small sockets from accidentally sliding through the slot 28. The raised upper edge 38 from the magnet 36 also further facilitates the ability to magnetically retain the drive sockets within the particular socket-receiving member 14 and to center such sockets therein. Each of the magnets 36 is a round ceramic magnet having sufficient magnetic strength so as to retain the socket within the socket-receiving members 14 and also allows the sockets to be easily released from the magnets 36 upon the application of a general upward pushing force by the fingers of the user of the socket holding device 10 of the present invention.

Figure 2:
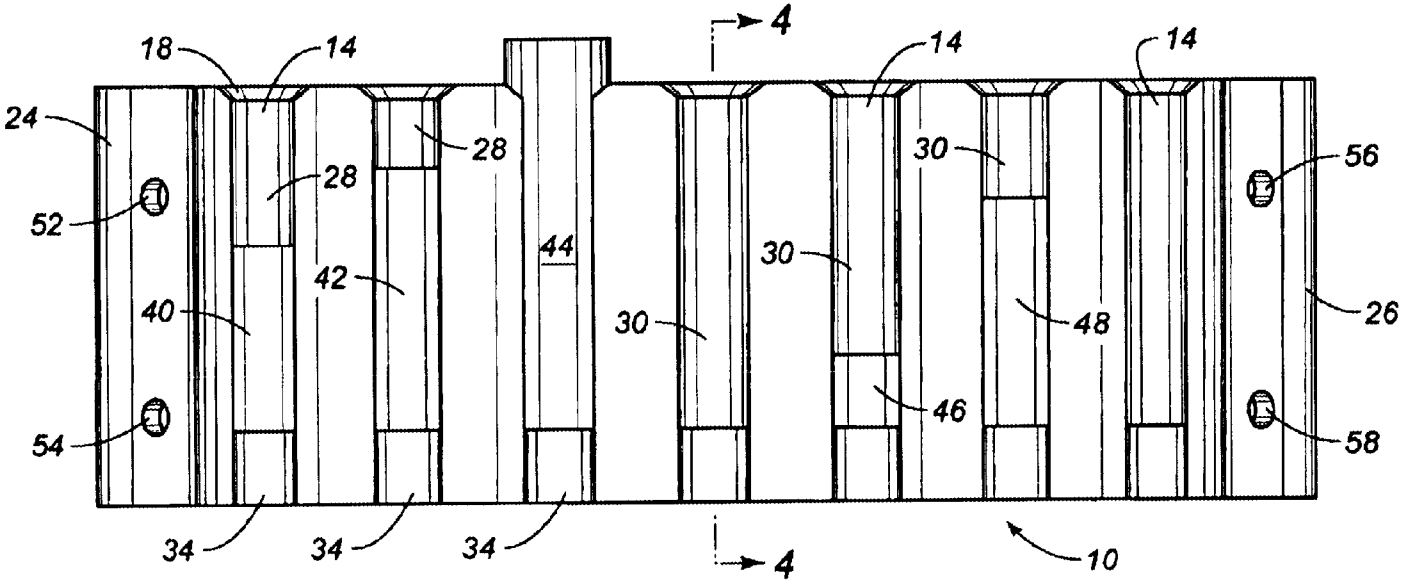
FIG. 2 is a frontal view of the socket holding device in accordance with the teachings of the present invention.

Referring to FIG. 2, the socket holding device 10 is particularly illustrated as receiving a variety of sockets 40, 42, 44, 46 and 48 therein. Each of the sockets 40, 42, 46 and 48 can be placed into the respective socket-receiving members 14 by the repairman during the course of the garage door repair, or other repair activities. As can be seen, the sockets 40 and 42 have a length which is less than the length of the particular socket-receiving members 14. As a result, in order to remove the sockets 40 and 42, the repairman will simply place a finger through the slot 28 and apply a general upward pressure on the exterior surface of the particular sockets 40 and 42. As a result, the sockets 40 and 42 will be released from their magnetic attraction to the magnet in the base 34. The sockets 40 and 42 will slide outwardly of the open top 18 of each of the socket-receiving members 14.

Socket 44 has a length which is greater than the length of the interior passageway 30 of the socket-receiving member 14 in which it is installed. As a result, it is only necessary for the repairman to grasp the upper end 50 of socket 44 so as to remove the socket 44 from its location within the socket-receiving member 14.

Sockets 46 and 48 have a configuration which is shorter than the length of the interior passageway 30 of the respective socket-receiving members 14. As a result, sockets 46 and 48 can be removed from the interior passageway 30 of the respective socket-receiving members 14 in the manner described in association with sockets 40 and 42. It is important to note that the sockets 40, 42, 44,46 and 48 are illustrated as having differing lengths. However, the socket holding device 10 of the present invention can also accommodate sockets having different diameters. In particular, the present invention, in its preferred embodiment, can accommodate sockets having a diameter of between ⅜"to 9/16".

In FIG. 2, for the purposes of illustration, the first wing member 24 is illustrated as having holes 52 and 54 formed therein. Similarly, wing member 26 is illustrated as having holes 56 and 58 formed therein. The holes 52, 54, 56 and 58 facilitate the ability to threadedly secure the socket holding device 10 to a tool belt.

Figure 3:
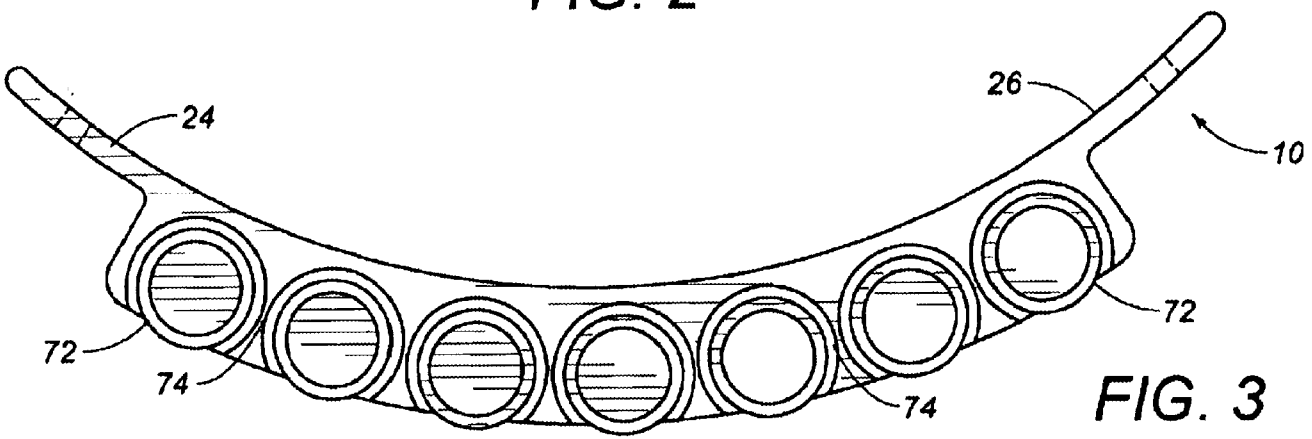
FIG. 3 is a plan view of the socket holding device in accordance with the teachings of the present invention.

In FIG. 3, the plan view of the tool holding device 10 of the present invention is particularly illustrated. In FIG. 3, the curved back surface 20 is particularly shown. The wing members 24 and 26 are formed in the body 22 at the ends of the socket-receiving members 14. In FIG. 3, it can be seen that there are a total of seven socket-receiving members 14. However, within the concept of the present invention, more or fewer socket-receiving members 14 can be included within the tool holding device of the present invention. FIG. 3 particularly illustrates the chamfered edges 32 associated with the open top 18 of the respective socket-receiving members 14. The socket-receiving members 14 are shown as integrally formed with the body 12. However, within the concept of the present invention, it is possible that the socket-receiving members 14 could be formed separately from the body 12 and affixed mechanically thereto.

Each of the socket-receiving members is illustrated as having a generally tubular configuration with interior passageway 30 extending therethrough. The slotted opening 28 is illustrated as opening on the forward surface 62 of the socket-receiving members 14. The base 34 has a generally circular configuration which allows the magnet 36 to be affixed therein.

Figure 4:
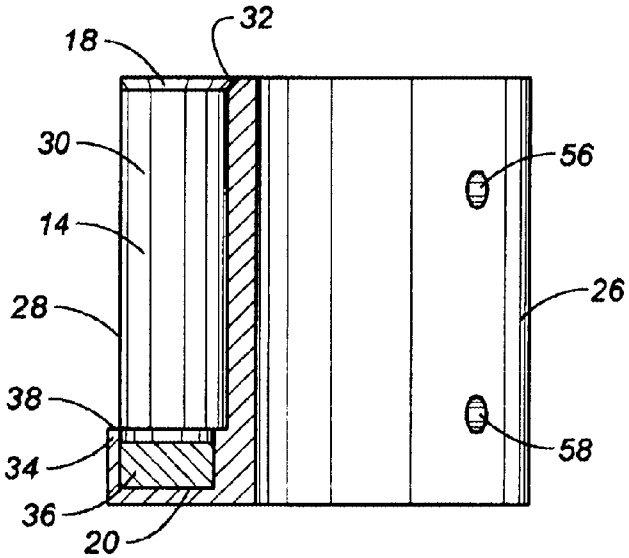
FIG. 4 is a cross-sectional view across lines 4—4 of FIG. 2 of the socket holding device of the present invention.

FIG. 4 shows a cross-sectional view of a socket-receiving member 14 in accordance with the teachings of the present invention. It can be seen that the socket-receiving member 14 has an open top 18 and a closed bottom 20. The open top 18 includes chamfered edge 32 serving to funnel a socket into the interior passageway 30 of the socket-receiving member 14. Slot 28 is formed on the outer surface of the socket-receiving member 14 so as to allow physical access to a socket retained within the interior passageway 30.

Importantly, the bottom 26 includes a base structure 34 having an upper edge 38. Magnet 36 is particularly illustrated as affixed within the base 34. The top of the magnet 36 is slightly lower than the top edge 38 of the base 34 so as to form the retaining area or ledge in which the socket can be physically retained. The wing member 26 is illustrated as extending in a curved manner outwardly of the back of the socket-receiving members 14. Holes 56 and 58 are illustrated as formed on the wing 26.

Figure 5:
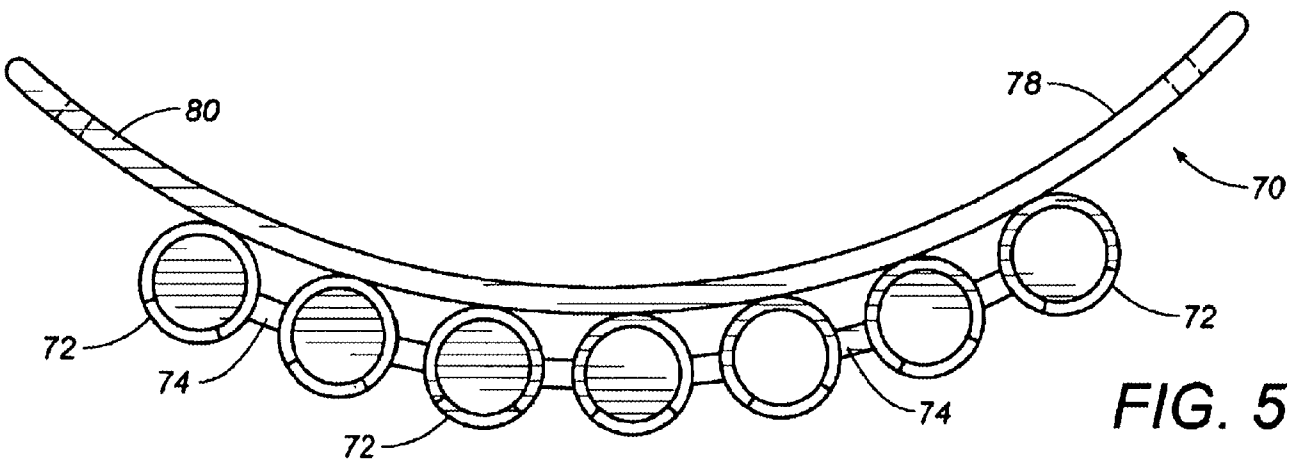
FIG. 5 is a plan view of an alternative embodiment of the socket holding device of the present invention.

FIG. 5 shows an alternative embodiment of the socket holding device 70 in accordance with the teachings of the present invention. Socket holding device 70 includes a plurality of generally tubular socket-receiving members 72 that are physically connected to each other by tabs 74. Suitable slotted areas can be formed on the forward face of the socket-receiving member 72 so as to facilitate access to sockets retained therein in the manner of the preferred embodiment of the present invention. A wing member 76 extends outwardly on one side of the socket-receiving members 72. Another wing member 78 extends outwardly from an opposite side of the socket-receiving members 72. Each of the wing members can receive fasteners so as to allow the device 70 to be attached to a belt.

It is to be noted that the present invention, in its variety embodiments, facilitates the ability of a worker to have access to the sockets. Since the worker places the various sizes of sockets within the various socket-receiving members, the worker is able to determine which sockets are most often used so as to place such sockets in their most convenient positions for access. For example, if only four primary sockets are used in a particular repair operation, then the worker may only wish to place the four sockets, in order of size, in the first four socket-receiving members as the device of the present invention. Alternatively, the worker may wish to place the sockets in an ordered relationship in order of most common usage. Still further, the worker may just wish to place the sockets in a random order within the socket holding device 10. The proper size of socket can be easily ascertained by feel through the slot associated with each of the socket-receiving members. The use of the magnets will prevent the sockets from sliding outwardly of the socket-receiving members when the worker moves to an inconvenient location, bends over, or otherwise removes the tool belt. However, the strength of the magnets will not prevent the worker from easily removing the socket from the socket-receiving members when it is time for use.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A socket holding apparatus comprising:

a body having a curved surface and a longitudinal axis; and a plurality of socket-receiving members formed on said curved surface, each of said plurality of socket-receiving members having a generally tubular configuration with an open top and a closed bottom, each of said plurality of socket-receiving members having a longitudinal axis transverse to said longitudinal axis of said body, each of said plurality of socket-receiving members having a base positioned at the closed bottom thereof, said base having a magnet positioned therein.

2. The apparatus of claim 1, said curved surface having a front surface and a back surface, said plurality of socket-receiving members being affixed to said front surface.

3. The apparatus of claim 2, said plurality of socket-receiving members being integrally formed with said body.

4. The apparatus of claim 2, said back surface having a curvature suitable for residing around a portion of a human waist.

5. The apparatus of claim 1, each of said plurality of socket-receiving members having a slot extending transverse to said longitudinal axis of said body, the slot of each of said plurality of socket-receiving members extending across a surface of the tubular configuration opposite said curved surface of said body.

6. The apparatus of claim 1, said base having a tubular configuration with an interior passageway generally coaxial with the generally tubular configuration of the socket-receiving member, said magnet positioned in said interior passageway.

7. The apparatus of claim 6, said base having a top edge, said magnet positioned so as to have a top surface slightly below said top edge of said base.

8. A socket holding apparatus comprising:

a body having a curved surface and a longitudinal axis; and a plurality of socket-receiving members formed on said curved surface, each of said plurality of socket-receiving members having a generally tubular configuration with an open top and a closed bottom, each of said plurality of socket-receiving members having a longitudinal axis transverse to said longitudinal axis of said body, said body having a first wing member extending outwardly from one side of said plurality of socket-receiving members, said body having a second wing member extending outwardly from an opposite side of said plurality of socket-receiving members, the apparatus further comprising:

attaching means formed on each of said first and second wing members, said attaching means for attaching said body to a belt.

9. The apparatus of claim 8, said attaching means comprising:

a pair of holes formed on said first wing member; and a pair of holes formed on said second wing member.

10. The apparatus of claim 1, further comprising:

a plurality of sockets respectively received in said plurality of socket-receiving members.

11. The apparatus of claim 10, said plurality of sockets having different sizes.

12. The apparatus of claim 1, each of said plurality of socket-receiving members having a chamfered surface at said open top, said chamfered surface narrowing toward an interior passageway of said generally tubular configuration.

13. A socket holding device comprising:

a body having a plurality of socket-receiving members integrally formed therewith, each of said plurality of socket-receiving members having a generally tubular configuration with an open top; and a plurality of magnets respectively affixed in a bottom of said plurality of socket-receiving members, said body having a curved back surface suitable for conforming to a human waist.

14. The device of claim 13, each of said plurality of socket-receiving members having a base positioned at said bottom thereof, said base having a tubular configuration with an interior passageway generally coaxial with said generally tubular configuration of the socket-receiving member, said base having a top edge, the magnet positioned so as to have a top surface slightly below said top edge of said base.

15. The device of claim 13, each of said plurality of socket-receiving members having a slot formed along a forward surface of said generally tubular configuration, said slot extending generally parallel to a longitudinal axis of said generally tubular configuration of the socket-receiving member.

* * * * *